United States Patent [19]

Sousek

[11] 4,192,103

[45] Mar. 11, 1980

[54] CUTTING REEL GRINDER WITH AUTOMATIC CONTROL

[75] Inventor: Eugene A. Sousek, Appleton, Wis.

[73] Assignee: Koehring Company, Brookfield, Wis.

[21] Appl. No.: 935,984

[22] Filed: Aug. 22, 1978

[51] Int. Cl.[2] ..... B24B 19/00

[52] U.S. Cl. ..... 51/249; 51/48 HE

[58] Field of Search ..... 51/249, 48 HE, 246

[56] References Cited

U.S. PATENT DOCUMENTS

Re. 28,200 10/1974 Witt et al. ..... 51/249

*Primary Examiner*—Othell M. Simpson
*Assistant Examiner*—Roscoe V. Parker
*Attorney, Agent, or Firm*—Burns, Doane, Swecker & Mathis

[57] ABSTRACT

A cutting reel grinder is disclosed which includes an automatic control for operating the grinding device as well as an indexing device that advances cutter reel knives for sharpening by the grinding device. The control includes a pair of electrical actuators: one actuator driving the indexing device; the other actuator driving the grinding device so as to translate it axially of the cutting reel. In addition, a plurality of cam-actuated switches are employed that are positioned with respect to the indexing device and the grinding device so as to shift the control circuit between an indexing cycle in which the cutter reel knives are repositioned with respect to the grinding device and a grinding cycle in which a properly indexed cutter knife is sharpened by the grinding device. A simple and efficient mechanical indexing device is driven by the one actuator and includes a geneva gear arrangement. A timing circuit provided in the control causes the indexing cycle and the grinding cycle to alternate repetitively for a predetermined period of time. In addition, the control provides a means whereby each knife of the cutting reel may be successively indexed without interruption by the grinding cycle.

18 Claims, 6 Drawing Figures

2
108
16
112
72
76
22
20
77
110
21
23
110
10
24
27
26
25
19
18
17
21
28
112

52
82
90
80
N.O.
N.C.
100
114
84
116
INPUT
102
118
112
B
88a
64
96
88b
24
A
T
76
94
86
N.C.
50
92
98
88c
N.O.
N.C.
N.O.
88d

CUTTING REEL GRINDER WITH AUTOMATIC CONTROL

BACKGROUND OF THE INVENTION

The present invention relates generally to apparatus for sharpening knives of a cutting reel. More particularly, the present invention concerns a sharpening device which is automatically operated to perform both grinding and indexing functions on the cutting reel.

In the past, various approaches have been used to the sharpen helical knives of a cutting reel. For example, the knives have been individually removed from the cutting reel for sharpening and then replaced. This procedure is time-consuming and generally unsatisfactory for cutting reels used in agricultural equipment in which the cutting edge of the reel is subject to long use and rapid wear. To overcome this problem, partially automated sharpening devices have been mounted on the equipment carrying the cutting reel so as to permit the individual knives to be sharpened without removing the cutting reel or its knives from the equipment. While these sharpening devices have taken various forms, one useful form is disclosed in U.S. Pat. No. Re. 28,200, issued Oct. 15, 1974 to Witt et al.

In this particular prior art device, a carriage is mounted for translation axially with respect to the cutting reel. The cutting reel itself is partially rotated as the grinding device translates on its carriage. This partial rotation of the cutter reel is effected in order to permit the grinding device to uniformly sharpen the edge of a helical cutting knife.

The Witt et al patent has an indexing device to automatically advance the cutter reel and present a subsequent knife after one knife has been sharpened. The particular indexing device, however, is a mechanically complex apparatus which includes a plurality of cams, detents, springs, levers, and mechanical elements which are actuated as the cutting reel is rotated during the grinding operation.

Such indexing devices are difficult and expensive to manufacture due to the multiplicity of parts required. A more significant problem occurs with use of the known indexing devices: as the elements move relative to one another wear develops on the abutting surfaces of the elements which cause after a substantial period of time inaccuracy in the operation of the indexing device. Because of the complexity of and the number of parts, it is difficult to adjust the indexing mechanism so as to accommodate the inevitable wear. It will, however, from a consideration of the importance of the position of the knife relative to the grinding device be apparent that inaccuracies and increased tolerances as a result of mechanical wear may cause such a mechanical indexing device to be unsuited for continued sharpening operations. Moreover, with the mechanical interrelation between the grinding and the indexing operations, it is possible for the grinding operation to become jammed while the indexing operation proceeds. In this event, substantial damage to the cutter knives may occur if they are advanced prior to completion of a sharpening cycle.

It will thus be seen that one of the substantial problems with fully automating the grinding and indexing operation of a sharpening unit for a cutting reel is the problem of separating the grinding operation from the indexing operation so as to avoid potential problems such as the knife damage discussed above.

Another problem with automation of the sharpening unit is the cumulative effect of tolerances in a plurality of mechanical elements. More particularly, the tolerances can permit sufficient lost motion or slack in the system that the timing of the indexing operation may get out of synchronization resulting in damage to the cutter knives. Obviously a damaged knife must be replaced causing loss of operating time and undesirable expense.

It will thus be apparent that the need continues to exist for a sharpening unit for a cutting reel which is capable of automated sharpening and indexing operations.

SUMMARY OF THE INVENTION

To overcome problems of the type discussed above, the present invention makes use of a simple, reliable indexing device which is not subject to accumulated tolerances and which is easily adjusted to compensate for wear. More specifically, a geneva movement is employed in which a driving gear carries a finger that is received by a corresponding radial slot of the driven geneva gear so as to advance the geneva gear through a predetermined angular increment. The geneva gear includes a plurality of radially extending slots with a corresponding plurality of arcuate recesses between the slots. Each arcuate recess has a diameter corresponding to that of the driving gear and is located between two adjacent slots. The driving gear is positioned within one of these recesses thereby providing a mechanical lock angularly fixing the driven geneva gear in a particular angular position. As the driving gear rotates, an undercut portion of the driving gear receives a projecting portion of the geneva gear permitting rotation of the geneva gear in response to engagement between the finger and a slot of the geneva gear.

In order to actuate the indexing and grinding operations and maintain a complete separation between these operations, the present invention makes use of an electrical control system and a pair of electrical actuators. One electrical actuator is provided to translate a carriage of the grinder means which moves axially with respect to the cutting reel. The second actuator is connected to the driving gear of the geneva movement so as to rotate the driven gear.

This electrical control system also includes camactuated contact switches which control the flow of electricity to the electrical actuators. A pair of the contact switches are angularly positioned around the path of a single cam carried by the driven gear and regulate the indexing cycle. One of these contact switches is effective to commence the indexing cycle so that the driven gear begins to rotate. As the driven gear rotates, a second switch closes to supply electrical current to the indexing actuator throughout the remaining portion of the indexing cycle and until the cam carried by the driving gear again breaks the circuit through the second contact switch. To assure that there is no overlap between the indexing and grinding cycles, the first and second contact switches are positioned so that the driven geneva gear has completed its movement before the cam engages the first contact switch at the end of the indexing cycle.

As the cam completes one revolution, it again engages the first contact switch which supplies electrical current to a third contact switch and to the electrical traversing movement actuator which drives the carriage of the grinding means. This switching effects commencement of the grinding cycle. As the carriage begins movement in the grinding cycle, a cam carried by the carriage disengages a third contact switch so that electrical current is supplied to the traversing movement to complete the grinding cycle. As the grinding cycle is completed, the carriage and the cam carried thereby engage the third contact switch shifting current from the traversing movement actuator, stopping the carriage. The current supplied to the third switch is shifted to the first contact switch thereby initiating the subsequent indexing cycle to advance a new cutting knife to the sharpening unit.

In order to sharpen a plurality of cutting knives without requiring an operator's assistance, the present invention includes a timing means which avoids the need for an operator stand by to manually index the successive cutting knives or to manually traverse the grinding mechanism across a particular knife. The timing means can be set to a preselected time value so as to grind each cutting knife at least once and, if desired, even two or more times. With such a timing device, the cutting operation can proceed virtually unattended by the machine operator.

As there are occasions when only one or less than the entire number of cutting knives require sharpening, the present invention also provides a means for disabling the grinding cycle while enabling the indexing cycle so that a cutter knife can be indexed and one or more successive knives can be indexed to the sharpening position without incurring an intermediate grinding cycle.

BRIEF DESCRIPTION OF THE DRAWINGS

Many objects and advantages of the present invention will be apparent to those skilled in the art when this specification is read in conjunction with the drawings wherein like reference numerals have been applied to like elements and wherein.

DESCRIPTION OF THE PREFERRED EMBODIMENT

Figure 1:
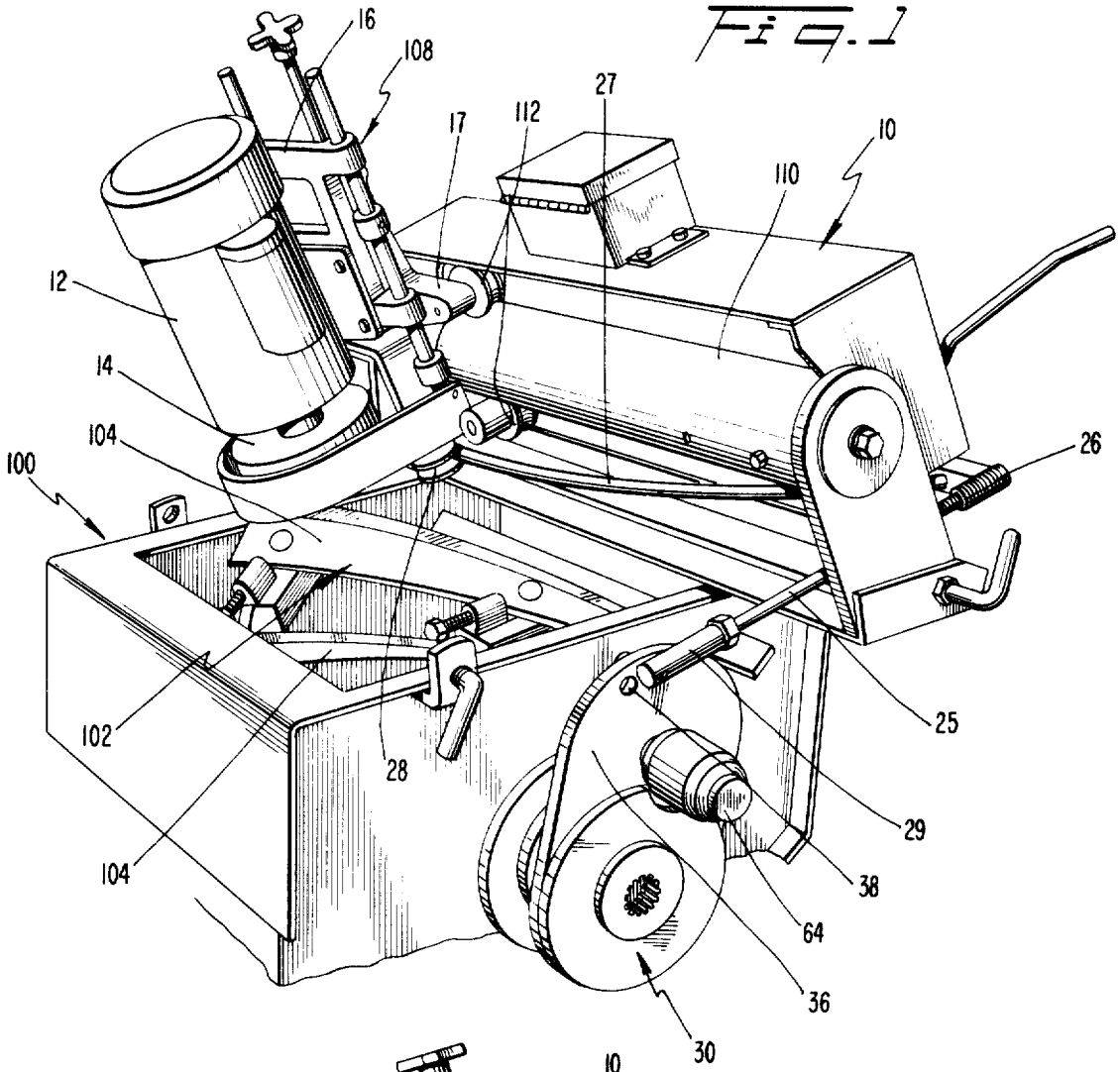
FIG. 1 is a perspective view of a cutting reel sharpening device with a control in accordance with the present invention.

Turning now to FIG. 1, a sharpening unit 10 is disclosed which is mounted in operative position on a suitable agricultural machine 100 having a cutting reel 102 with a plurality of equiangularly spaced helical cutting knives 104. The sharpening unit 10 includes a grinder 108 having a motor 12 which carries a grinding wheel 14. To permit a vertical adjustment of the grinding wheel 14, the motor 12 is carried on a suitable vertical adjustment assembly 16 which is mounted on a translatable carriage 17 of the sharpening unit 10. The translatable carriage 17 is transversely moveable axially of the cutting reel 102 and is operable to traverse the entire axial width of the cutting reel so that the entire length of a knife 104 can be sharpened by the grinding wheel 14.

Figure 2:
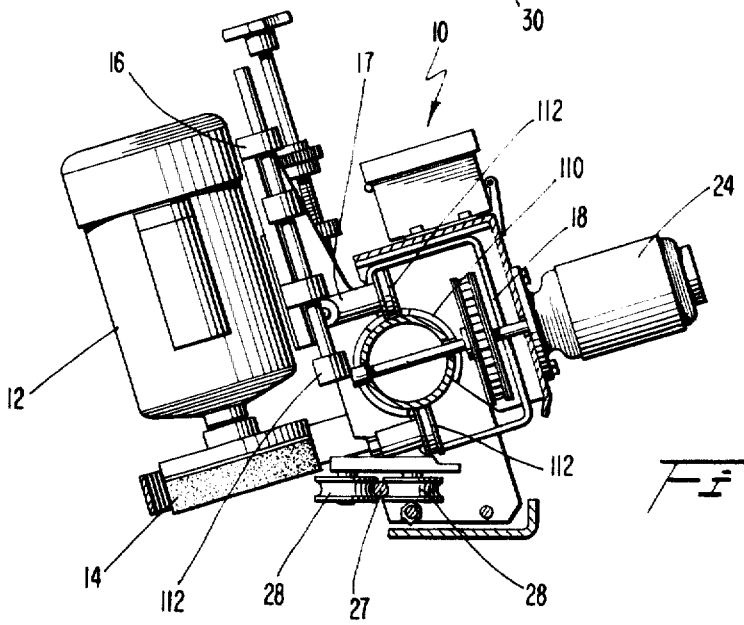
FIG. 2 is a partial cross-sectional view taken along the line 2—2 of FIG. 3.

To guide the carriage 17 during translatory movement, a generally cylindrical guide tube 110 is provided in the sharpening unit 10. As illustrated in FIG. 2, the carriage is mounted on rollers 112 that engage the guide tube 110.

Traversing movement of the carriage 17 is effected by a bracket 18 attached to the carriage 17 so as to pass around the guide tube 110. This bracket 18 includes a slot 19 (see FIG. 3) oriented transversely of the guide tube 110. A pin 20 is attached to a chain 21 and received by the slot 19 so that the bracket 18 and the carriage will translate as the chain 21 moves around the sprockets 22, 23 which support the chain.

Automation of the grinding cycle is accomplished by an electrical actuator, such as a motor 24, which drives the sprocket 22, and hence the chain 21, through a suitable power transfer mechanism.

As the carriage traverses the cutting reel (see FIG. 1), the angular position of the cutting reel 102 must be varied where the knives 104 are helical in configuration. To effect this adjustment, a mechanical linkage is actuated in response to position of the carriage 17. More specifically, an arm 25 is connected at one end to a base plate 36 of an indexing device 30. A second end of the arm 25 is connected to a universal joint 26 carried at a free end of a cam bar 27 which is pivotally connected at its other end 28 (see FIG. 3) to the sharpening unit 10. The cam bar 27 is straddled by a plurality of rollers 28 (see FIG. 2) having concave surfaces engaging the cam bar 27. In order to initially adjust the angular position of the cutting reel 102 with respect to the grinding wheel 14 (see FIG. 1), the arm 25 includes a length adjustment assembly 29.

Figure 4:
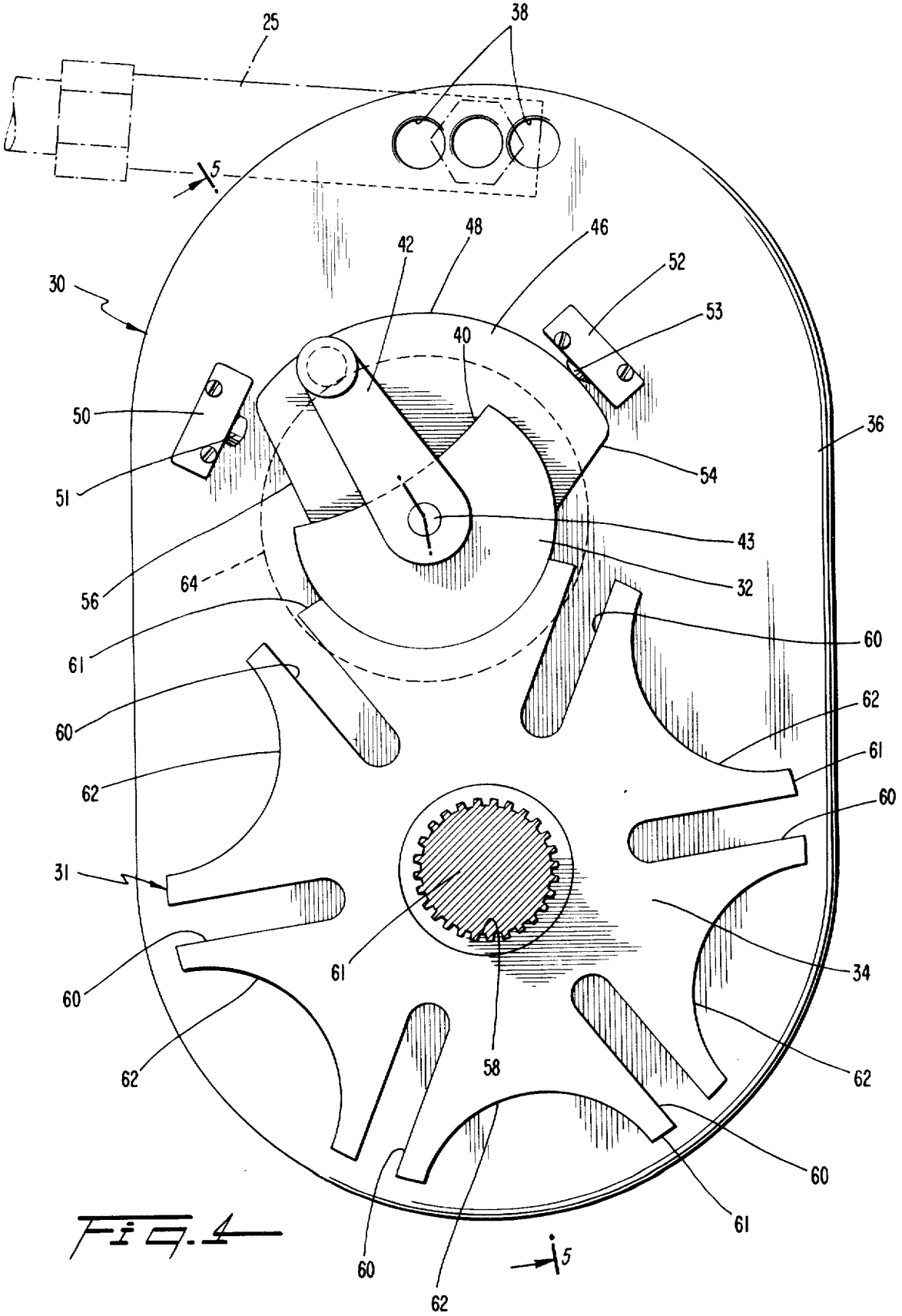
FIG. 4 is an enlarged detail view of the mechanical indexing movement employed by the present invention.

The indexing assembly 30 includes a geneva movement 31 (see FIG. 4) that includes a driving gear 32 and a driven geneva wheel 34. Both the driving gear 32 and the driven gear 34 may be suitably rotatably mounted on the base plate 36 which is provided with one or more suitable adjustment holes 38 in the upper end portion thereof. The arm 25 from the grinding assembly is attached to one of the holes 38, the plurality of holes shown being effective to provide additional angular adjustability to the cutting reel.

Figure 5:
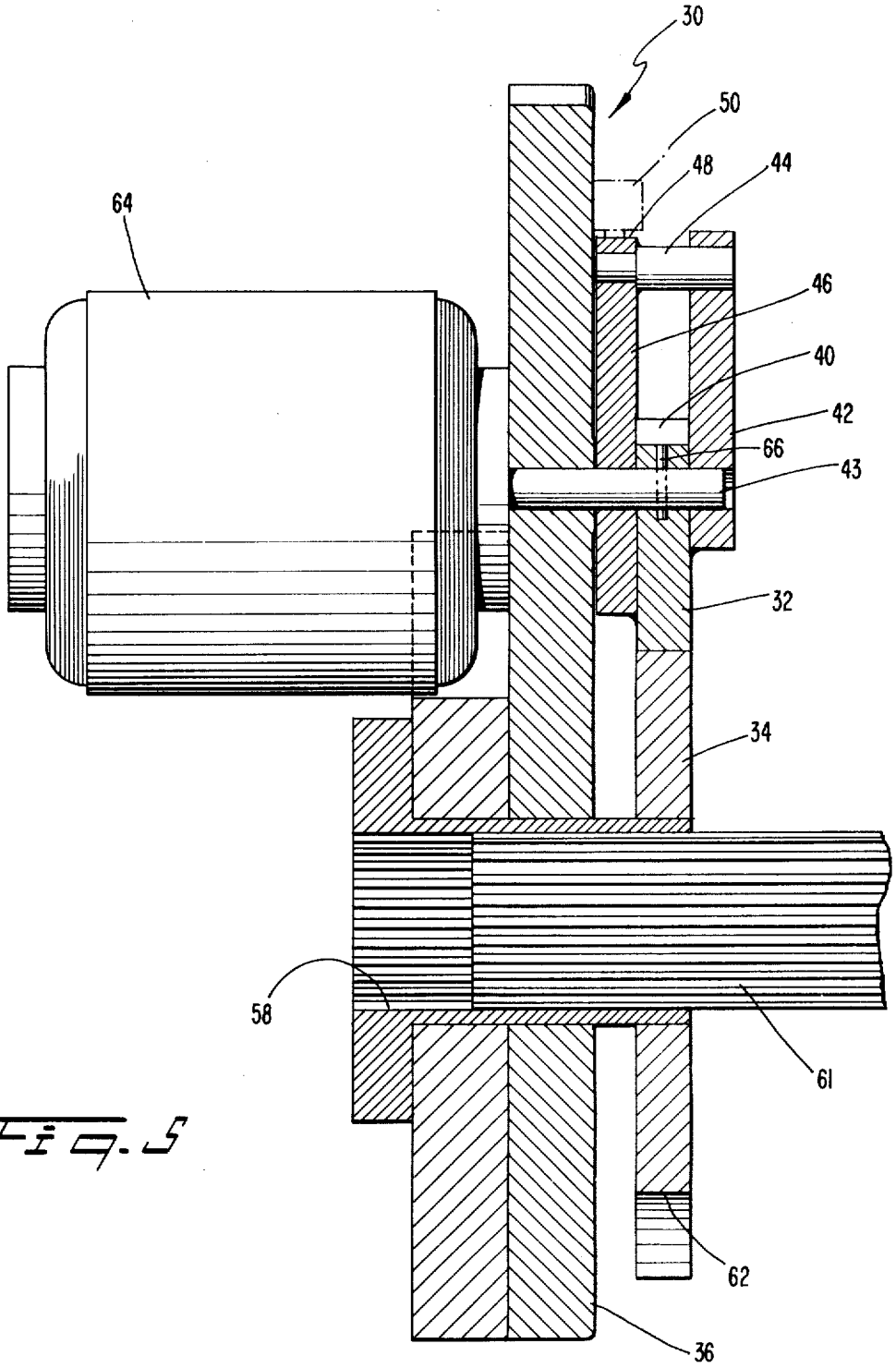
FIG. 5 is a view in partial cross section taken along the line 5—5 of FIG. 4.

The driving gear 32 has a first diameter and has an undercut 40 in a portion of its circumferences. The driving gear carries an arm 42 which extends radially from the center of the shaft 43 of the driving gear 32 and is oriented so as to essentially bisect the undercut surface portion 40 of the driving gear 32. Near the distal end of the arm 42, there is an engagement means such as a pin 44 (see FIG. 5), which is generally circular in cross section and parallel to the shaft 43.

The driving gear 32 is also provided with an angularly extending cam 46 (see FIG. 4) positioned between the gear 32 and the base plate 36 and having a constant radius peripheral surface portion 48 adapted to actuate an appropriately positioned contact switches 50, 52. The cam 46 is generally parallel to the finger 42 (see FIG. 5) and is spaced therefrom by a distance which is at least equal to the thickness of the driven geneva gear 34 or the driving gear 32 whichever is greater. In this manner, peripheral portions of the geneva gear 34 can pass between the finger 42 and the cam 46 through the undercut portion 40 as the driving gear 32 rotates about its axis.

Returning briefly to the cam 46 (see FIG. 4), the arc length of the surface portion 48 between the leading edge 54 and the trailing edge 56 is selected to be less than the arc length at the same radius between actuators 51, 53 the contact switches 50, 52. In this fashion, the cam surface 48 will only engage one of the two contact switches 50, 52 at any angular position of its rotation.

The angular position of the first contact switches 50, is also important: the first contact switch 50 must be positioned such that the leading edge 54 of the cam does not contact the actuator 51 before the arm 42 is perpendicular to a slot 60 of the geneva gear 34. In this way, the indexing movement effected by the geneva gear 34 is complete before the contact switch 50 is engaged by the cam 46.

The geneva gear at 34 is rotatably mounted on the base plate 36 and is provided with the splined centrally disposed opening 58 which is adapted to receive one end of the shaft of a suitable conventional cutting reel. A plurality of radially oriented slots 60 cooperate with the pin 44 that cooperate with the pin to rotate the driven gear 34 about its axis 61. Thus, each slot 60 has a circumferential width slightly greater than the pin 44 and a radial length sufficiently great to allow the pin to pass through an imaginary line connecting the axis 61 and the center of the shaft 43. The radially oriented slots 60 are equi-angularly positioned about the periphery of the driven gear 34 so as to advance an associated cutting reel through a predetermined angle thereby positioning a successive knife to be sharpened by the grinding unit.

The geneva wheel 34 of the present invention is illustrated with six slots 60 and would be adapatable for use with a cutting reel having six knives. However, the number of slots 60 provided on the geneva wheel is in no way intended to be limiting. In this connection, since a cutting reel will ordinarily have an integral number of knives, the geneva gear 34 would have a corresponding integral number of radially extending slots 60. The slots would be positioned around the circumference of the geneva gear 34 with an angle which corresponds to 360° divided the integral number of knives. Accordingly, rotation of the geneva gear 34 will advance the cutting reel through a predetermined angle.

Interdigitated between the plurality of radially extending slots 60 is a plurality of arcuate recesses 62. Each arcuate recess 62 is fabricated so as to have a radius which corresponds to the radius of the driving gear 32. Moreover, the shaft 43 of the driving gear 32 is located on the base plate 36 at the center of the arc describing the recess 62. In this manner, each recess 62 of the driven gear functions as a socket to receive the driving gear 32 during a substantial portion of its rotation. This socket-like interaction between the driving gear 32 and the driven gear 34 while the geneva gear 34 is not being advanced provides a positive angular positioning device for the geneva gear relative to the base plate 36. Accordingly, there is no possibility that the geneva gear 34 can inadvertently advance a successive cutter blade into the grinding wheel. Moreover, the angular positioning is effected without introducing additional mechanical components which must be actuated and which are subject to wear.

In order to rotate the driving gear 32, an electrical actuator such as a suitable conventional electric motor 64 (see FIG. 4) is mounted on the external surface of the base plate 36. The motor 64 is connected to the shaft 43 projecting through the base plate 36 and to which the driving gear 32 is rotationally fixed by a transverse pin 66 or other suitable device. Accordingly, as the electrical actuator 64 rotates, the driving gear 32 also rotates to drive the cooperating geneva gear 34.

Figure 3:
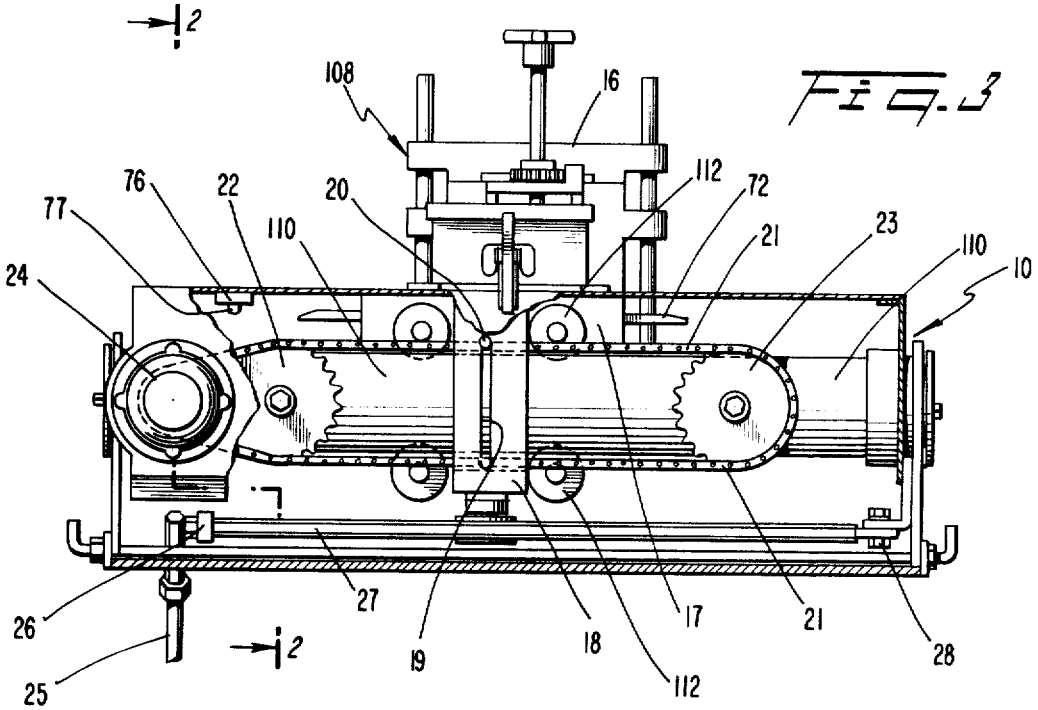
FIG. 3 is an elevational view of the carriage drive assembly with portions broken away in the interest of clarity.

Turning now to FIG. 3, to determine the position of the carriage of the grinding unit, a cam 72 is attached to the carriage and is operably positioned to engage an actuator 77 of a third contact switch 76 at one end of the sharpening unit. This third contact switch 76 is thus effective to signal when the sharpening cycle has been completed.

Figure 6:
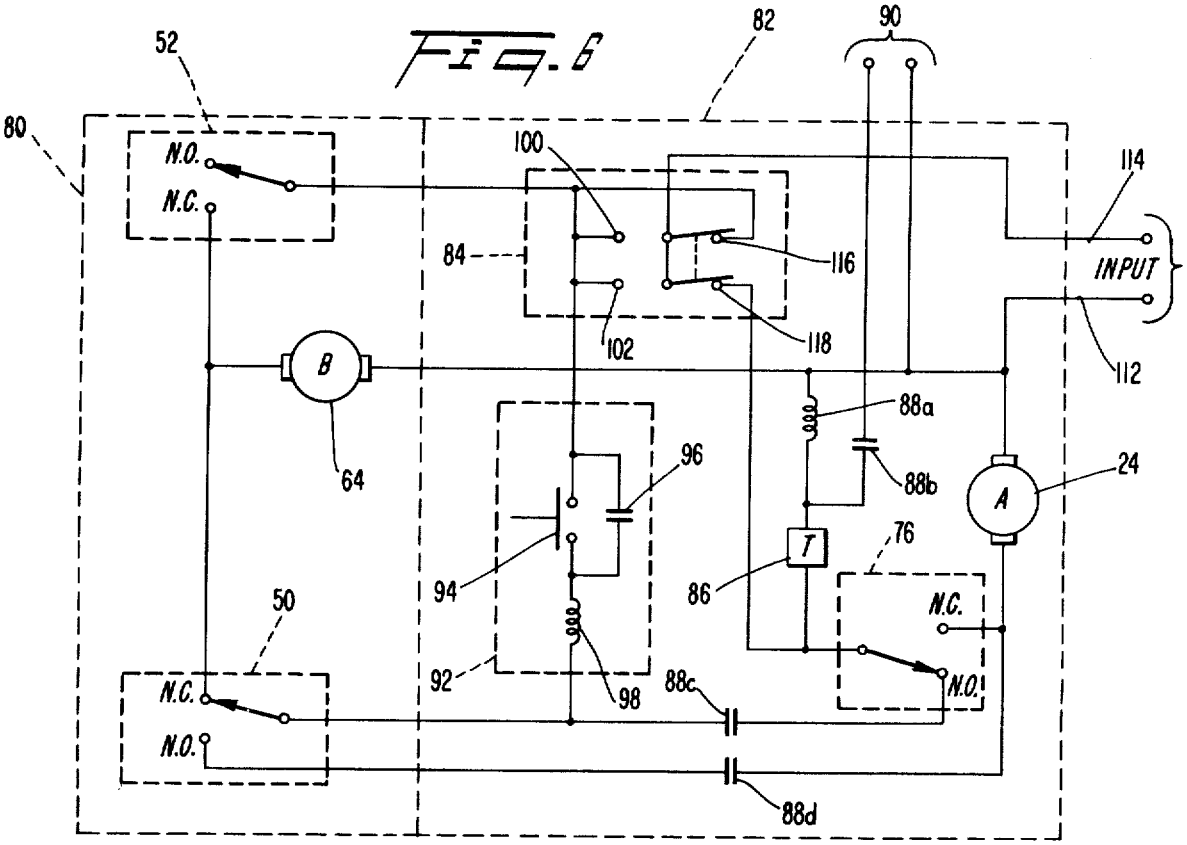
FIG. 6 is a schematic diagram of an electrical control circuit in accordance with the present invention.

The first electrical actuator 24 drives the carriage assembly of the grinding unit transversely with respect to the cutting reel being sharpened. This first electrical actuator 24 as well as the second electrical actuator 64 are operated by an electrical control circuit which also constitutes a portion of the present invention. The control circuit for the motors 24, 64 is illustrated in FIG. 6. It includes a first portion 80 attached to the indexing assembly 30, that includes the contact switches 50, 52 and the motor 64 and a second portion 82 which includes the motor 24 attached to the housing of the grinding unit and the third contact switch 76 as well as additional components to be described more fully below. Each of the limit switches 50, 52, 76 may be of the single-pole, double-throw type with the corresponding actuator 51, 53, 77 being resiliently biased to a normally closed position. Accordingly, each switch has a normally closed "NC" terminal and a second normally open "NO" terminal. Movement between the normally closed and the normally open positions is effected by the associated actuator and a corresponding cam; cam 46 in the case of switches 50, 52; cam 72 in the case of switch 76. The portion 82 of the control circuit includes a selector switch 84 which is a suitable conventional double-pole, double-throw switch.

In one operating mode, the selector switch 84 permits successive indexing and grinding cycles to take place. In a second operating mode, the selector switch 84 permits only the indexing cycle to occur. To further automate the sharpening unit, a suitable conventional timing circuit 86 is connected in series with the selector switch 84 and a solenoid **88*a* of a relay. The solenoid 88*a* controls three sets of normally open contacts 88*b*, 88*c*, 88*d*. The contact 88*b* functions as a switch to regulate power at the output terminals 90 which may be connected with the grinder motor 12 (see FIG. 1). The normally open contacts 88*c* and 88*d* (see FIG. 6) control electrical communication between the first contact switch 50 and both the third contact switch 76 and the motor 24**, respectively.

As noted, the selector switch 84 also provides an automatic indexing function in which grinding does not occur. This function is accomplished by connecting a starting circuit 92 in series with the selector switch 84 and the first contact switch 50. The starting circuit 92 may include, for example, a momentary contact switch 94 connected in parallel with a normally open contact 96 which is controlled by a solenoid 98 connected in series with the momentary contact switch 94 and the contact 96. In this manner, the solenoid will hold the starting circuit 92 closed by closing the contacts until current through the starting circuit is interrupted.

Connections between the components of the electrical control will now be described. The center terminal of the second contact switch 52 is connected to terminals 116, 100 of the selector switch 84. The normally closed position of the switch 52 is connected directly with the motor 64 of the indexing assembly; the normally open position being unconnected.

Turning now to the first contact switch 50, the normally closed contact position is connected with the indexing motor 64 whereas the normally open contact position is connected through contact 88*d* with both the traversing motor 24 and the normally closed terminal of the third contact switch 76. The center terminal of the first contact switch 50 is directly connected with the starting circuit 92 and is connected through contact 88*c* with the normally open terminal of the third contact switch 76.

The center terminal of the third contact switch 76 is connected to a conductor between the timing circuit 86 and the selector switch 84; whereas, the normally closed terminal is in electrical communication with the traversing motor 24.

In order that the output terminals 90 can receive energy from the input conductors 112, 114 and be energized only when the timing circuit 86 is enabled, one conductor of the output terminals 90 is provided with the normally open contact 88*b* which is operable only through the timing circuit. Thus, the output terminals 90 are effectively switched by the timing circuit 86.

Conductors 112, 114 provide the input energy for the control circuit. The first conductor 114 is connected with the center terminal of the selector switch 84. The second conductor 112 is connected with both motors 24, 64 and with the relay solenoid 88*a*.

With the selector switch 84 in the continuous operating position (i.e., sequential indexing and grinding) (illustrated in FIG. 6) one terminal 116 is connected with the input terminal of the second contact switch 52. The second output terminal of the control switch 118 is connected to the center terminal of the third contact switch 76 as well as to the timing circuit 86.

When the control circuit is operated in its indexing mode, the selector switch engages output terminals 100, 102 both of which are connected with the center terminal of the second contact switch 52 as well as with the starting circuit.

In operation, the sharpening unit 10 (see FIG. 1) must be mounted on the machine in operative position. In addition, the indexing assembly must be connected to the cutting reel 102 and the arm 25. The vertically adjustable carriage 16 is adjusted to contact the edge of a knife 104. Naturally, suitable adjustments of the connection of the arm 25 with the base plate 36 and the assembly 29 are made first so that the knife is properly positioned relative to the grinding wheel 14.

Next, the operator of the sharpening unit must select either continuous sharpening and indexing operations or merely the indexing operation by means of the selector switch 84 (see FIG. 6). Assuming that the operator wishes to have all the cutter knives successively sharpened, the timing circuit 86 would be adjusted to a preselected time value. Setting the timing circuit 86 permits electrical current to pass through the solenoid 88*a*, energizing it and thereby closing normally open contacts 88*b*, 88*c*, 88*d*. Accordingly, upon closure of the contact 88*b*, the grinding motor 12 which may be connected to terminals 90 begins operation.

At the time the control unit is initially started, the cam 46 (see FIG. 4) of the driving gear 32 will be positioned in contact with the second limit switch 52 and out of contact with the first limit switch 50. Accordingly, the first contact switch 50 (see FIG. 6) will be in its normally closed position whereas the second contact switch 52 will be in its normally open position. In addition, the cam 72 (see FIG. 3) carried by the translating carriage 17 will be in engagement with the third contact switch 76 placing it in its normally open position. Thus, the thru contact switches 50, 52, 76 will be in the configurations illustrated in FIG. 6.

Current is supplied through the third limit switch 76 and the contact 88*c* to the first limit switch 50 and to the indexing motor 64. Accordingly, the driving gear 32 (see FIG. 4) will commence rotation. As the cam 46 moves past the second contact switch 52, the second contact switch 52 will assume its normally closed position so that current can flow directly from the selector switch 84 (see FIG. 6) through the second contact switch 52 to drive the motor 64.

Continued rotation of the driving gear 32 (see FIG. 4) causes engagement of the pin 44 with next radial slot 60 of the driven geneva gear 34 thus rotating the geneva gear 34 through one predetermined angular increment. At the end of this indexing increment, the cam surface 48 of the driving gear 32 engages the plunger 51 of the first limit switch 50. Because of the angular orientation of the first contact switch 50, a peripheral portion of the geneva gear 34 will advance past the undercut 40 of the driving gear 40 to the position 61' at the time the leading cam edge 54 engages the plunger 51. Thus actual indexing is now complete. The indexing cycle can be defined as the period during which the cam 46 rotates, it being understood that actual mechanical movement of the cutting reel occurs in less than half of this time period.

Engagement of the plunger 51 shifts current supplied to the first limit switch 50 to the normally open terminal thereof where it is in direct communication with the first motor 24 through the contact 88*d*. Accordingly, with the indexing cycle now being essentially complete (i.e., cutting reel movement is finished) the translatable carriage 17 (see FIG. 3) is driven by the translating motor 24 so that the cam 72 moves out of engagement with the plunger 77 of the third contact switch 76. At this point, the grinding cycle has commenced and the actual indexing cycle has terminated, further movement of the cam 46 being necessary to return it to its original position.

As the cam 72 moves out of engagement with the contct switch 76, the contact switch 76 (see FIG. 6) shifts to its normally closed position whereby current is delivered directly to the first translating motor 24 so that the carriage 17 carrying the grinder motor laterally traverses the knife to be sharpened and returns to its original position.

It will be observed that at the beginning of this movement, the closed configuration of the second contact switch 52 causes the indexing motor 64 to continue driving until the cam surface 48 engages the plunger 53 of the second contact switch 52, thereby shutting itself off. Accordingly, the indexing unit is poised in position to commence a subsequent indexing cycle.

The return of the grinding carriage to its parking position causes the cam 72 (see FIG. 3) carried thereby to engage the third contact switch 76 and shift the electrical current (FIG. 6) from the translating motor 24 to the first limit switch 50 commencing the indexing cycle again. At this point it will be clear that the next indexing cycle cannot commence until the grinding cycle has been completed and the carriage returns to its parking position.

The alternating sequence of indexing cycles and sharpening cycles continues until the timing circuit 86 interrupts current flowing through the solenoid 88*a* thereby opening the contacts 88*b*, 88*c*, 88*d* so as to stop further operation of the sharpening unit. With the third contact switch 76 connected directly with the selector switch 84, the carriage 17 will return to its parking position even if the timer 86 times out in the middle of the grinding cycle. Moreover, with the second contact switch 52 connected to the selector switch 84, the indexing cycle will likewise be completed even if the timer 86 stops at an intermediate time. Thus, the unit is always ready to begin operation from the same point.

When it is desired to merely index the cutting reel to advance a subsequent or different knife to the grinding wheel 14, the selector switch 84 is thrown to its alternate position (the contact 100, 102). Upon depression of the momentary contact switch 94, the solenoid 98 will be actuated to hold the contact 96 closed and supply current to the first contact switch 50 and thence to the indexing motor 64. The interaction of the cam 46 with the first and second contact switches 50, 52 as described above will perform only one indexing cycle. The presence of the contact 96 in series with the switch 50 effectively terminates the indexing cycle after one revolution of the driving gear 32.

It should now be apparent that there has been provided in accordance with the present invention a novel control and indexing apparatus for sharpening units operating on the knives of cutting reels.

In addition, the control unit of the present invention is not susceptible to problems of the type discussed in connection with the prior art while overcoming problems heretofor encountered with automation of grinding and indexing cycles.

It will now be apparent to those skilled in the art that there has been provided in accordance with the present invention a novel automated sharpening device and control circuit therefor. Moreover, it will be apparent to those skilled in the art that numerous modifications, variations, substitutions, and equivalents exist for features of the present invention which do not materially depart from the spirit and scope of this invention. Accordingly, it is expressly intended that all such modifications, variations, substitutions, and equivalents which fall within the spirit and scope of the invention as defined in the appended claims be embraced thereby.

What is claimed is:

1. An automatic sharpening unit for a cutting reel of the type having a plurality of helical knives, comprising:

grinding means operable to grind the edge of a helical knife and having a translatable carriage and a first electrical actuator to move the carriage;

indexing means for connection to a cutting reel, having a second electrical actuator operable to rotate a cutting reel through a predetermined angle that is integrally divisible into 360°; and electrical control means connected with the first and second actuators for regulating the grinding means and the indexing means, operable to drive the indexing means through the predetermined angle and to subsequently cause the translatable carriage to traverse and sharpen a helical knife.

2. The automatic shapening unit of claim 1 wherein the indexing means includes a geneva gear means to effect rotation of a cutter reel through the predetermined angle.

3. The automatic sharpening unit of claim 2 wherein the geneva gear means includes:

a geneva gear having a plurality of radially extending slots equiangularly spaced at the predetermined angle and a corresponding plurality of arcuate recesses interdigitated with the slots;

a driving gear connected to the second actuator, coplanar with the geneva gear, positioned to be received by one of the arcuate recesses, and having an undercut surface portion contoured to permit the geneva gear to pass as the driving gear advances to a successive arcuate recess and engagement means received by the slot to advance the geneva gear.

4. The automatic sharpening unit of claim 3 wherein:

the driving gear includes an arcuate cam; and the electrical control means includes a pair of switches positioned to be contacted by the arcuate cam, one switch being operable to initiate movement of the second actuator at the beginning of an indexing cycle and to initiate movement of the first actuator at the end of an indexing cycle, the other switch being operable to cause movement of the second actuator during an intermediate portion of the indexing cycle.

5. The automatic sharpening unit of claim 4 wherein the electrical control means further includes a third switch operable to cause continued movement of the first actuator at the end of the indexing cycle and being cam actuated by a second cam carried by the translatable carriage to terminate a grinding cycle and initiate a subsequent indexing cycle.

6. The automatic sharpening unit of claim 5 wherein the electrical control means includes an adjustable timing means for operating the grinding means and the indexing means through a predetermined number of alternating indexing and grinding cycles.

7. The automatic sharpening unit of either claim 5 or claim 6 wherein the electrical control means includes means for selectively operating the indexing means through one indexing cycle.

8. The automatic sharpening unit of claim 1 wherein the electrical control means includes three switches, the first switch being operable to initiate movement of the second actuator at the beginning of an indexing cycle and to initiate movement of the first actuator at the end of the indexing cycle, the second switch being operable to cause continued movement of the second actuator during an intermediate portion of the indexing cycle, and the third switch being operable to cause continued movement of the first actuator at the end of the indexing cycle and to operate the grinding means throughout a grinding cycle.

9. The automatic sharpening unit of claim 8 wherein the electrical control means includes an adjustable timing means for operating the grinding means and the indexing means through a predetermined number of alternating indexing and grinding cycles.

10. The automatic sharpening unit of claim 8 or claim 9 wherein the electrical control means includes means for selectively operating the indexing means through one indexing cycle.

11. The automatic sharpening unit of claim 8 wherein the first and second switches are operated by a cam carried by the indexing means.

12. The automatic sharpening unit of claim 8 wherein the third switch is operated by a second cam carried by the grinding means.

13. In an automatic sharpening unit for helical knives of a cutting reel, having a grinding means for sharpening the knives and an indexing means for advancing successive knives to the grinding means, the improvement comprising:

first electrical actuator means connected with the grinding means for translating the grinding means;

second electrical actuator means connected with the indexing means for driving the indexing means;

electrical control means connected with the first and second electrical actuators, operable to sequentially excite the first and second actuators to drive the indexing means through an indexing cycle and to drive the grinding means through a grinding cycle.

14. The sharpening unit of claim 13 wherein the electrical control means includes three switches, the first switch being operable to initiate movement of the second actuator at the beginning of an indexing cycle and to initiate movement of the first actuator at the end of the indexing cycle, the second switch being operable to cause continued movement of the second actuator during an intermediate portion of the indexing cycle, and the third switch being operable to cause continued movement of the first actuator at the end of the indexing cycle and to operate the grinding means throughout a grinding cycle.

15. The sharpening unit of claim 14 wherein the electrical control means includes an adjustable timing means for operating the grinding means and the indexing means through a predetermined number of alternating indexing and grinding cycles.

16. The sharpening unit of claim 14 or claim 15 wherein the electrical control means includes means for selectively operating the indexing means through one indexing cycle.

17. The sharpening unit of claim 16 wherein the first and second switches are operated by a cam carried by the indexing means.

18. The sharpening unit of claim 16 wherein the third switch is operated by a second cam carried by the grinding means.

* * * * *